US011772295B2

(12) United States Patent
Bathke

(10) Patent No.: US 11,772,295 B2
(45) Date of Patent: Oct. 3, 2023

(54) CHAIN SAW AND METHOD FOR TENSIONING A SAW CHAIN OF A CHAIN SAW

(71) Applicant: Andreas Stihl AG & Co. KG, Waiblingen (DE)

(72) Inventor: Lars Bathke, Rudersberg (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 17/498,541

(22) Filed: Oct. 11, 2021

(65) Prior Publication Data

US 2022/0111551 A1 Apr. 14, 2022

(30) Foreign Application Priority Data

Oct. 12, 2020 (EP) ..... 20201376

(51) Int. Cl.
*B27B 17/14* (2006.01)
*B27B 17/02* (2006.01)
*B27B 17/08* (2006.01)

(52) U.S. Cl.
CPC ..... *B27B 17/14* (2013.01); *B27B 17/02* (2013.01); *B27B 17/08* (2013.01)

(58) Field of Classification Search
CPC ..... B27B 17/02; B27B 17/14; B27B 17/00
See application file for complete search history.

(56) References Cited

U.S. PATENT DOCUMENTS

| | | | | |
|---|---|---|---|---|
| 3,390,710 | A * | 7/1968 | Cookson | B27B 17/14 30/381 |
| 5,997,423 | A | 12/1999 | Kwon | |
| 6,564,459 | B1 * | 5/2003 | Steinbrueck | B27B 17/14 30/375 |
| 6,944,958 | B1 | 9/2005 | King | |
| 7,743,513 | B1 * | 6/2010 | Fisher | B27B 17/14 30/386 |
| 2004/0262131 | A1 | 12/2004 | Forster et al. | |
| 2018/0281225 | A1 | 10/2018 | Gerstenberger et al. | |

FOREIGN PATENT DOCUMENTS

| | | | | |
|---|---|---|---|---|
| DE | 1173 229 | B | 7/1964 | |
| DE | 34 33 746 | C1 | 3/1986 | |
| DE | 203 1 9 743 | U1 | 3/2005 | |
| EP | 3 385 045 | A1 | 10/2018 | |
| WO | 2011/155880 | A1 | 12/2011 | |
| WO | WO-2011155880 | A1 * | 12/2011 | B27B 17/14 |

* cited by examiner

*Primary Examiner* — Jennifer S Matthews
(74) *Attorney, Agent, or Firm* — Walter Ottesen, P.A.

(57) ABSTRACT

The disclosure relates to a chain saw having a housing and a drive motor. The guide bar is held on the housing by way of a releasable fastening arrangement and, when the fastening arrangement is released, by way of a tensioning device is displaceable in relation to the housing in the direction of the longitudinal axis of the guide bar. The chain saw includes a chain lifting device which is configured separately from the tensioning device. The chain lifting device in a deflected position of the chain lifting device is configured for deflecting the saw chain when the tensioning device tensions the saw chain, and in an operating position of the chain lifting device is configured for relaxing the saw chain when the guide bar is fixed.

18 Claims, 5 Drawing Sheets

CHAIN SAW AND METHOD FOR TENSIONING A SAW CHAIN OF A CHAIN SAW

CROSS REFERENCE TO RELATED APPLICATION

This application claims priority of European patent application no. 20 201 376.9, filed Oct. 12, 2020, the entire content of which is incorporated herein by reference.

TECHNICAL FIELD

The disclosure relates to a chain saw. The disclosure furthermore relates to a method for tensioning a saw chain of a chain saw.

BACKGROUND

Known in principle are chain saws having a housing and a drive motor, the drive motor of the chain saws, by way of a chain drive sprocket, driving in a revolving manner a saw chain guided in a guide groove of a guide bar. The guide bar is held on the housing by way of a releasable fastening arrangement. When the fastening arrangement is released, the guide bar by way of a tensioning device can be displaced in relation to the housing in the direction of the longitudinal axis of the guide bar.

The readjustment of the tension of chain saws of this type is often considered difficult, in particular for non-professional users, because the latter lack the experience required for choosing the correct tensioning force for tensioning the saw chain. If the saw chain is too firmly tensioned the friction between the saw chain and the guide bar increases, as a result of which increased wear on the components is created. If the saw chain is too loosely tensioned, this can result in the saw chain being released from the guide bar or from the chain drive sprocket. The saw chain or other components of the chain saw can be damaged here. The range within which the tension force that needs to be selected has to be adjusted is comparatively small, in particular in chain saws which have only a small motor output, in particular copse cutters. As a result, the readjustment of the tension of the saw chain in the case of chain saws of this type becomes particularly difficult for the operator.

SUMMARY

It is an object of the disclosure to refine a chain saw in such a manner that simple tensioning of the saw chain by the operator is made possible.

The object can, for example, be achieved by a chain saw including: a housing; a saw chain; a chain drive sprocket; a guide bar defining a guide groove and a longitudinal axis; the saw chain being configured to be guided in the guide groove; a drive motor configured to drive the saw chain in a revolving manner via the chain drive sprocket; the guide bar having a longitudinal plane defined by the guide groove; a tensioning device; a releasable fastening arrangement configured to hold the guide bar on the housing; the guide bar being displaceable via the tensioning device in relation to the housing in a direction of the longitudinal axis of the guide bar when the releasable fastening arrangement is released; a chain lifting device configured separately from the tensioning device; the chain lifting device, when in a deflected position, being configured to deflect the saw chain when the tensioning device tensions the saw chain; and, the chain lifting device, when in an operating position, being configured to relax the saw chain when the guide bar is fixed.

It is a further object of the disclosure to specify a method for tensioning a saw chain of a chain saw, the method enabling a simple tensioning of the saw chain by an operator.

The object can, for example, be achieved by a method for tensioning a saw chain of a chain saw. The chain saw includes a housing and a drive motor; the drive motor being configured to, via a chain drive sprocket, drive a saw chain guided on a guide bar in a revolving manner; the guide bar being held on the housing via a releasable fastening arrangement; and, the guide bar, when the fastening arrangement is released, being displaceable in relation to the housing in the direction of a longitudinal axis of the guide bar via a tensioning device. The method includes: deflecting the saw chain via the chain lifting device when the tensioning device tensions the saw chain and the chain lifting device is in a deflected position; and, relaxing the saw chain via the chain lifting device when the guide bar is fixed and the chain lifting device is in an operating position.

The chain saw includes a housing and a drive motor. The drive motor by way of a chain drive sprocket drives in a revolving manner a saw chain guided in a guide groove of a guide bar. The guide bar has a longitudinal plane defined by the guide groove. The guide bar is held on the housing by way of a releasable fastening arrangement. When the fastening arrangement is released, the guide bar by way of a tensioning device is displaceable in relation to the housing in the direction of the longitudinal axis of the guide bar. The chain saw includes a chain lifting device which is configured separately from the tensioning device. The chain lifting device in a deflected position of the chain lifting device is configured for deflecting the saw chain when the tensioning device tensions the saw chain. Furthermore, the chain lifting device in an operating position of the chain lifting device is configured for relaxing the saw chain when the guide bar is fixed.

In order for the tension of the saw chain to be readjusted, the fastening arrangement of the chain saw thus has to be released, wherein the guide bar by way of the tensioning device is pushed toward the front, in the direction of the longitudinal axis of the guide bar away from the chain drive sprocket, and the saw chain is tensioned. When tensioning the saw chain, the chain lifting device is situated in the deflected position thereof, as a result of which the saw chain is deflected by way of the chain lifting device. The guide bar is subsequently fixed by the fastening arrangement. In this fastened position of the fastening arrangement, the chain lifting device is situated in an operating position in which the saw chain is no longer deflected by the chain lifting device. In this position, the guide bar is held so as to be clamped by the fastening arrangement. The saw chain is relaxed in the operating position of the chain lifting device. As a result of the initial deflection of the saw chain, a targeted predefined play in the chain is adjusted. An increased tension of the saw chain and friction forces associated therewith are avoided. The readjustment of the tension of the saw chain by way of an excessive tensioning force can thus be avoided.

The chain lifting device can preferably include a deflection element which acts on the saw chain. The saw chain is deflected by the deflection element of the chain lifting device. The guide bar forms a guide path provided for the saw chain, wherein the deflection element in the deflected position of the chain lifting device preferably lifts the saw chain at a predetermined spacing from the guide path. As a result of this predetermined spacing, the desired play in the chain is generated in the relaxed state of the saw chain, thus in the operating position of the chain lifting device. As a result, the identical tensioning force can be set in a simple, reproducible manner when readjusting the tension of the chain saw.

According to an aspect of the disclosure, it is considered advantageous that the saw chain in the deflected position bears on the deflection element of the chain lifting device. As a result of the direct contact between the deflection element of the chain lifting device and the saw chain, the deflection of the saw chain can be exactly adjusted. Alternatively, magnets, in particular electromagnets, which deflect the chain by a magnetic force can also be used.

The deflection element of the chain lifting device can preferably be able to be moved laterally to the longitudinal plane. The deflection element can thus be displaced into the guide groove and out of the latter again. The deflection element of the chain lifting device can preferably be mounted so as to be pivotable in relation to the guide groove. The deflection element in the deflected position is pivoted into the guide groove and lifts the saw chain away from the base of the guide groove. The deflection element in the operating position is pivoted laterally out of the guide groove as a result of which the saw chain is able to be moved again in the direction toward the base of the guide groove. As a result thereof, a predetermined play in the chain of the saw chain is ensured. The deflection element can preferably be arranged on the bottom side of the guide bar. As a result of gravity, the saw chain sags on the bottom side of the guide bar and offers enough space to enable the deflection element of the chain lifting device to pivot into the guide groove.

According to an aspect of the disclosure, it is considered advantageous that the deflection element in the deflected position protrudes into the guide groove of the guide bar and lifts the drive links of the saw chain away from the groove base of the guide bar. The deflection element in the operating position pivots out of the guide groove so far that the drive links of the saw chain can drop down again in the direction toward the groove base.

A positioning element for moving the deflection element can preferably be provided. The positioning element in the operating position of the chain lifting device can preferably act on the deflection element. The positioning element here acts on the deflection element in such a manner that the latter is pressed out of the guide groove and vacates the guide groove for the drive links of the saw chain.

The deflection element can preferably be configured so as to be integral to the guide bar. As a result, a simple construction of the chain saw and simple assembling of the latter can be enabled.

According to an aspect of the disclosure, it is considered advantageous that the fastening arrangement acts on the chain lifting device in such a manner that the chain lifting device in the fastened position of the fastening arrangement is situated in the operating position. According to an aspect of the disclosure, it is considered advantageous that the fastening arrangement and the chain lifting device are mutually adapted in such a manner that the guide bar, when the fastening arrangement is released, is tensioned by the tensioning device and the chain lifting device is situated in the deflected position. As a result of the interaction between the fastening arrangement and the chain lifting device, the operator can easily perform the adjustment of the pre-tension of the saw chain. The operator has only to release or fix, respectively, the fastening arrangement, wherein the chain lifting device is simultaneously activated or deactivated, respectively. As a result, operator errors when tensioning the saw chain can be avoided.

It is in particular provided that the tensioning device includes a spring element which in the direction of the longitudinal axis of the guide bar pre-tensions the guide bar away from the housing. As a result, the pre-tensioning of the saw chain takes place automatically by the tensioning device. The operator has no influence on the magnitude of the tensioning force, as a result of which variations in terms of the magnitude of the pre-tension of the saw chain can be avoided. Approximately identical pre-tensioning of the saw chain is thus achieved in each new tensioning procedure of the saw chain. The tensioning force by way of which the guide bar is pushed toward the front and by way of which the saw chain is pre-tensioned, corresponds to the spring force of the spring element. Excessive tensioning forces which may arise when the guide bar is displaced by hand are avoided as a result.

According to an aspect of the disclosure, it is considered advantageous that the fastening arrangement and the chain lifting device are mutually adapted in such a manner that the fastening arrangement in a partially released position holds the guide bar and the chain lifting device is situated in the deflected position. When readjusting the tension of the saw chain, the deflection element thus first engages in the guide groove, and the saw chain is subsequently tensioned. It is thus ensured that, prior to tensioning the saw chain, the deflection element is positioned between the drive links of the saw chain and the groove base of the guide bar. If the guide bar were to be pre-tensioned already prior to the deflection element being pivoted into the guide groove, the deflection element would only pivot laterally toward the saw chain. A deflection of the saw chain away from the groove base of the guide bar would no longer be possible in this instance. In an alternative embodiment it can be expedient for the deflection element to have a ramp configured on the end of the deflection element that faces the saw chain. The ramp is configured in such a manner that the saw chain, when laterally contacting the deflection element, by way of the ramp of the deflection element is pushed in the direction away from the groove base. The saw chain can thus likewise be tensioned.

According to an aspect of the disclosure, it is considered advantageous that the fastening arrangement includes a chain wheel cover and a clamping element disposed on the chain wheel cover, the guide bar by way of the clamping element being pressed against the housing. Accordingly, the guide bar can preferably be held so as to be clamped directly between the housing and the clamping element. The fastening arrangement can preferably include a spring unit, the clamping element by way of the spring unit being mounted on the chain wheel cover transversely to the longitudinal plane of the guide bar. The spring force exerted by the spring unit acts transversely to the longitudinal plane of the guide bar. The spring unit here is supported by way of the chain wheel cover and presses the clamping element against the guide bar.

A clamping force which acts from the clamping element on the guide bar in the fastened position and in the partially released position of the fastening arrangement can preferably be greater than a tensioning force acting from the tensioning device on the guide bar. A dual-stage tensioning process of the saw chain is enabled as a result. When changing from the fastened position to the partially released position of the fastening arrangement, only the deflection element is pivoted into the guide groove. As a result of the pre-tension of the clamping element, the guide bar continues to be held in a clamped manner. The clamping force is greater than the tensioning force of the tensioning device.

The fastening arrangement can be completely released only once the deflection element has pivoted into the guide groove, as a result of which the clamping force is cancelled and the guide bar is tensioned toward the front. The clamping force acting on the guide bar in this position of the fastening arrangement is lower than the tensioning force. The saw chain is tensioned and comes to bear on the deflection element.

The fastened position of the fastening arrangement can subsequently be assumed again. The guide bar by way of the clamping element is clamped against the housing and fixed herein. The deflection element is pushed out of the guide groove by way of the positioning element. The operating position of the chain lifting device is assumed again, and the tension of the saw chain has been readjusted with a predetermined play in the chain.

BRIEF DESCRIPTION OF THE DRAWINGS

The invention will now be described with reference to the drawings wherein.

DESCRIPTION OF THE PREFERRED EMBODIMENTS

Figure 1:
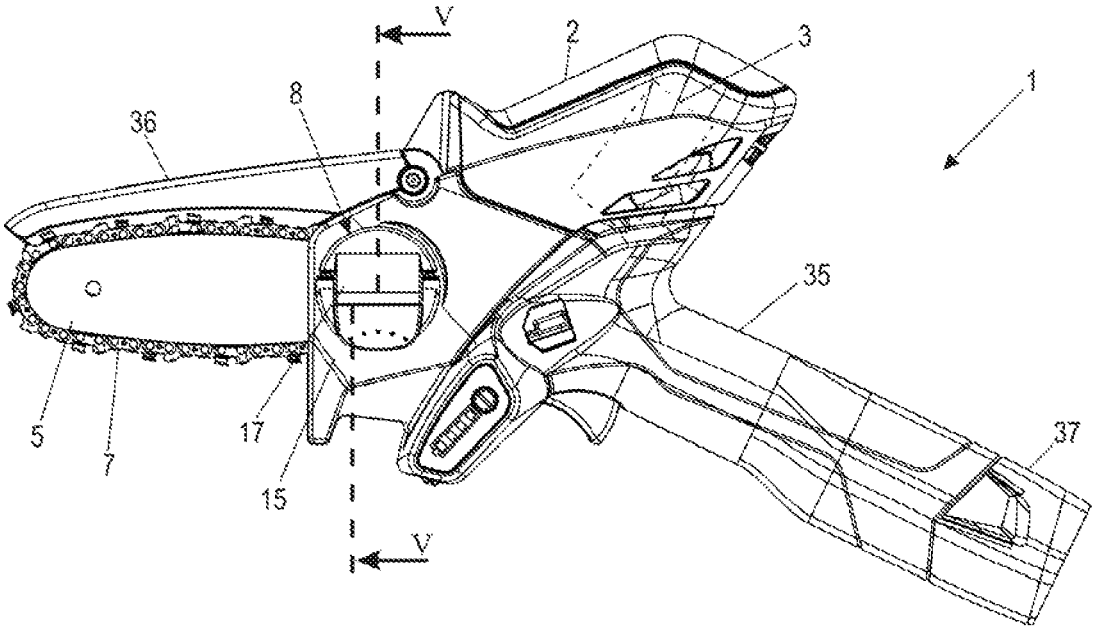
FIG. 1, in a lateral illustration, shows a chain saw.
Figure 2:
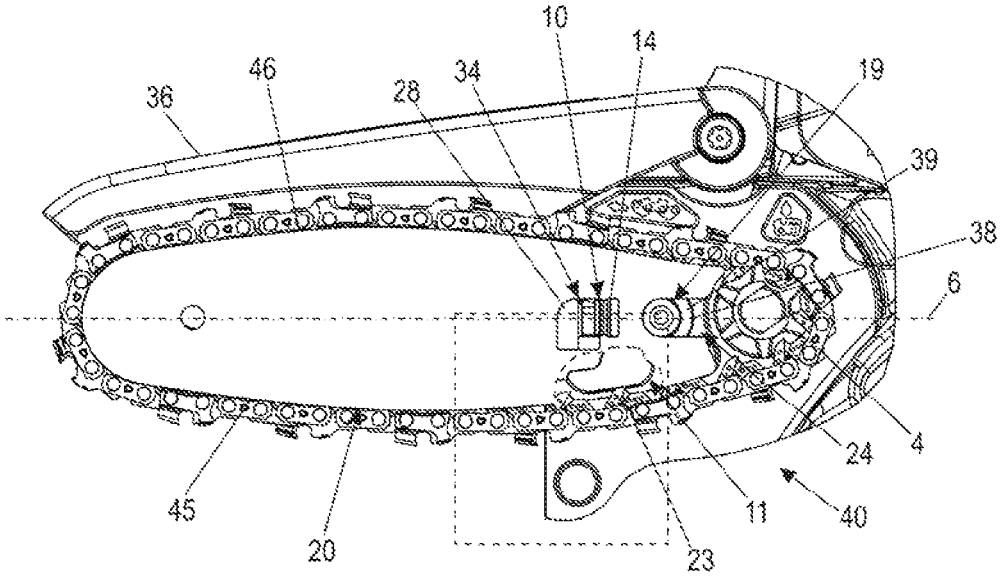
FIG. 2, in a fragmented illustration, shows the guide bar having a chain lifting device.

A hand-held chain saw according to the disclosure which in the embodiment is configured as a copse cutter is shown in FIG. 1. The chain saw 1 includes a housing 2 having a handle 35. The chain saw 1 furthermore includes a drive motor 3 which is only schematically illustrated, a guide bar 5 and a saw chain 7. The saw chain 7 is driven by the drive motor 3 and by way of a chain drive sprocket 4 so as to revolve about the guide bar 5 (FIG. 2). The drive motor 3 in the embodiment is configured as an electric motor which is supplied with power from a battery 37. The battery 37 in the embodiment is disposed on the rear end of the handle 35. The electric motor can also be supplied with power by way of a connecting cable. The drive motor 3 in an alternative embodiment can also be configured as an internal combustion engine, in particular as a two-stroke engine or as a mixture-lubricated four-stroke engine.

As is shown in FIG. 1, the guide bar 5 protrudes toward the front on that side of the housing 2 that lies opposite the handle 35. A pivotable cover 36 which extends along the guide bar 5 and at least partially protrudes beyond the guide bar 5 is disposed on the housing 2. The cover 36 can be pivoted away from the guide bar 5 in the upward direction.

Figure 6:
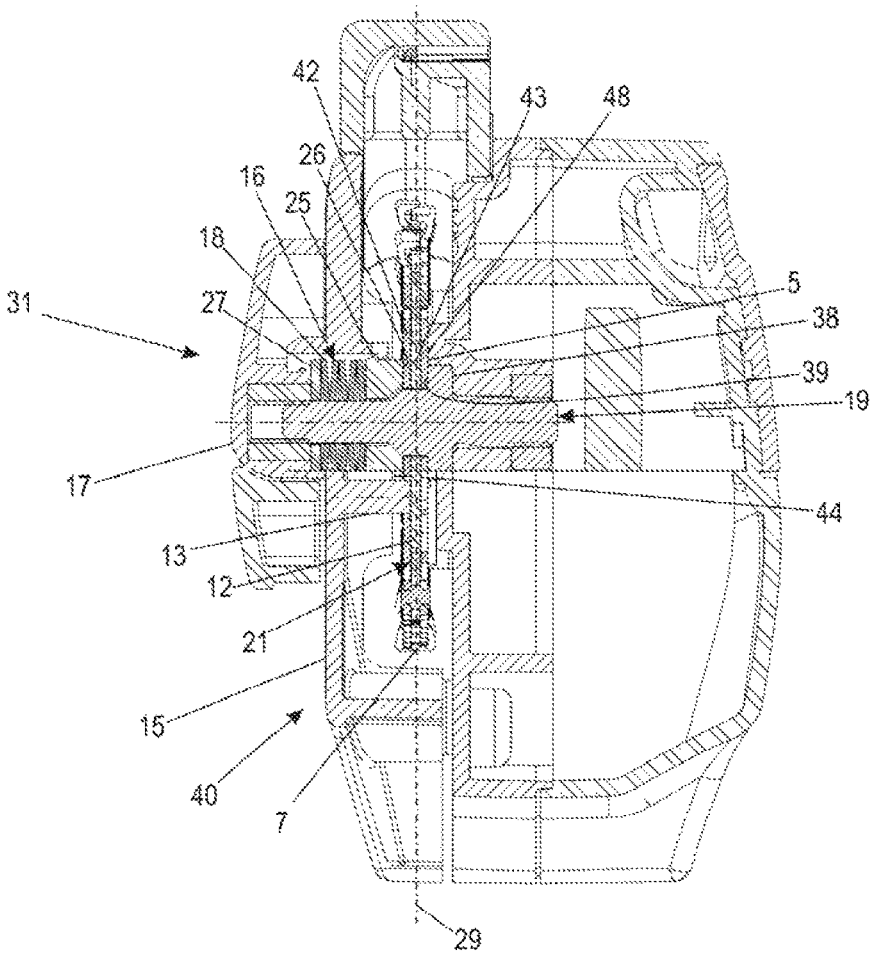
FIG. 6, in a sectional illustration along the arrows V in FIG. 1, shows the chain saw in the deflected position of the chain lifting device in a partially released position of the fastening arrangement.
Figure 7:
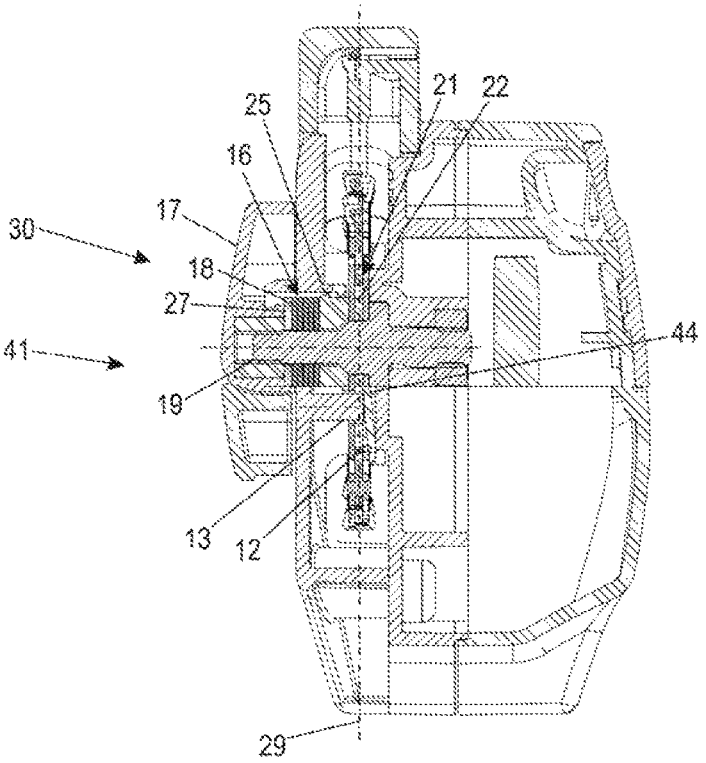
FIG. 7, in a sectional illustration along the arrows V in FIG. 1, shows the chain saw in the operating position of the chain lifting device in a fastened position of the fastening arrangement.
Figure 8:
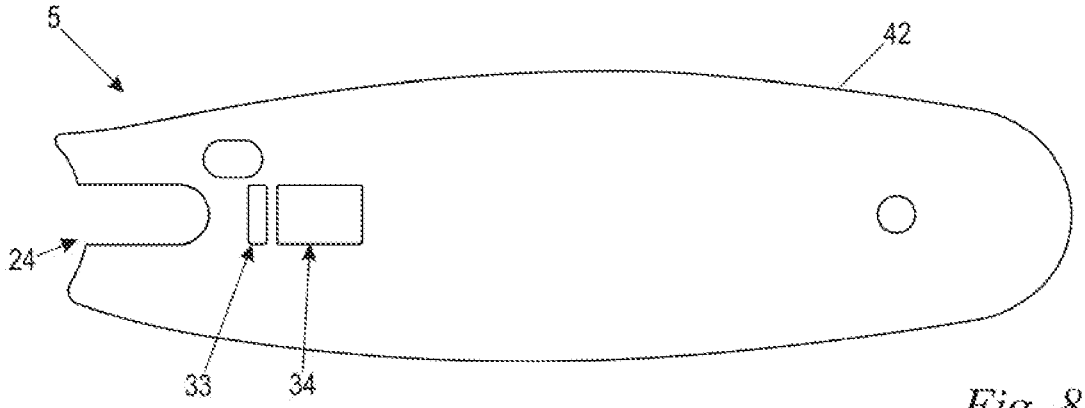
FIG. 8, in a lateral illustration, shows the first side element of the guide bar.
Figure 9:
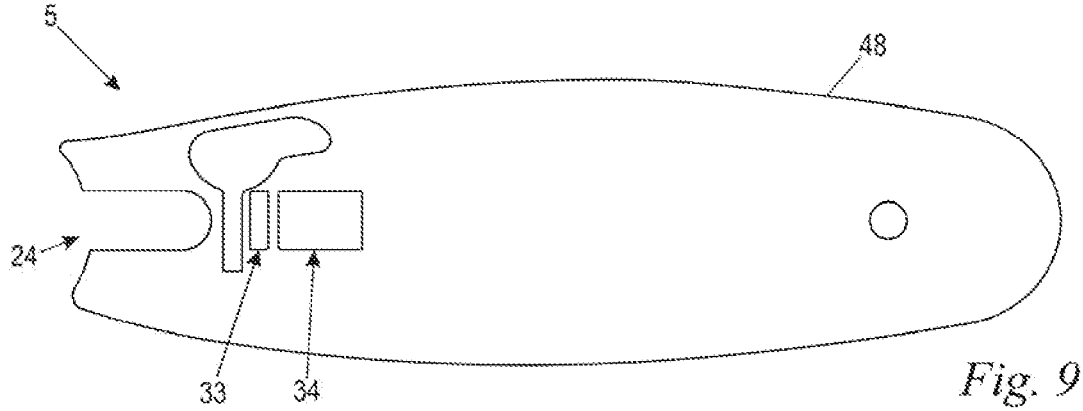
FIG. 9, in a lateral illustration, shows the second side element of the guide bar.
Figure 10:
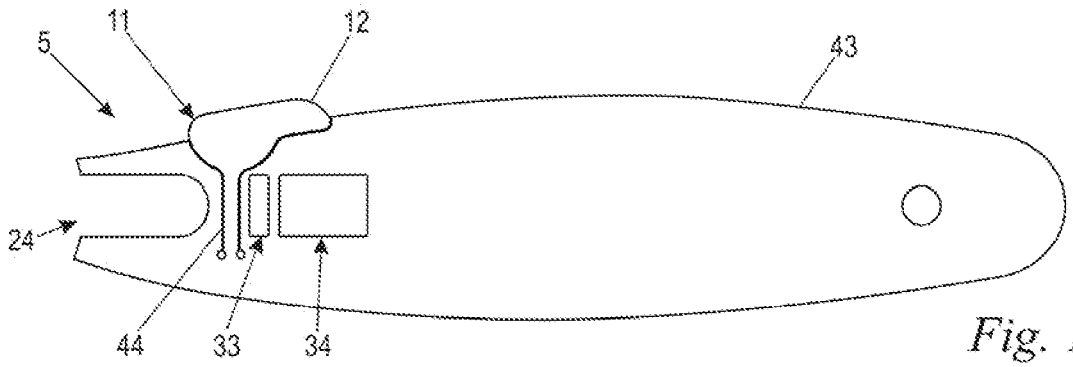
FIG. 10, in a lateral illustration, shows the middle element of the guide bar.
Figure 11:
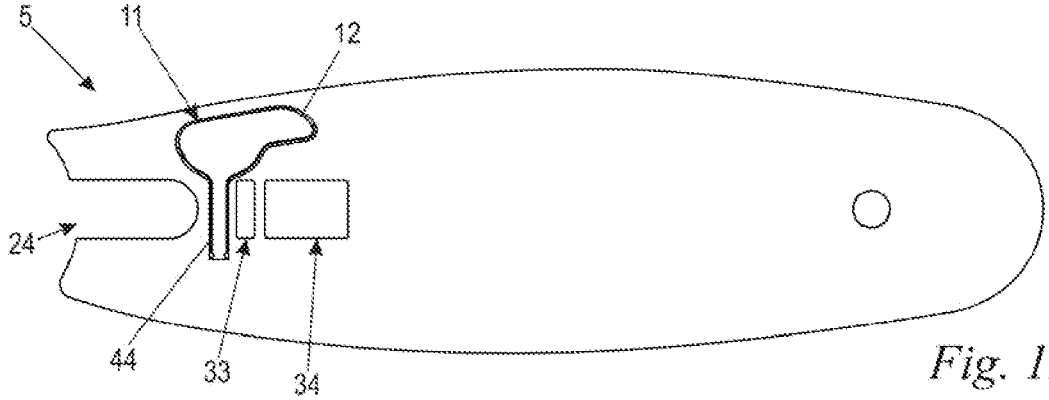
FIG. 11, in a lateral illustration, shows the guide bar in the assembled state; and, FIG. 12, in a perspective sectional illustration, shows the chain saw with a spring element.

As is shown in FIG. 1, the chain saw 1 includes a releasable fastening arrangement 8 by way of which the guide bar 5 is held on the housing 2. The fastening arrangement 8 includes a chain wheel cover 15 and a clamping element 16 disposed on the chain wheel cover 15 (FIGS. 6 and 7). Moreover, the fastening arrangement 8 includes a nut 17 which is disposed on the chain wheel cover 15 and serves for fastening the chain wheel cover 15 to the housing 2. In the embodiment the nut 17 is configured as a wingnut. The wing of the nut 17 is pivotable and can be pivoted outward in order for the nut 17 to be rotated. As a result, the operator of the chain saw 1 can activate the fastening arrangement 8 in a tool-free manner, thus without any additional tool.

As is shown in FIG. 2, the chain saw 1 includes a stud bolt 19 which in the embodiment possesses two threaded portions which are mutually separated by an encircling collar 38. That threaded portion of the stud bolt 19 that faces the housing 2 is screwed into the housing 2. The guide bar 5 is fixed on that threaded portion of the stud bolt 19 that protrudes outward. To this end, a receptacle opening 24 is provided on the guide bar 5, the stud bolt 19 protruding through the receptacle opening 24. The receptacle opening 24 in the embodiment is configured as an elongate bore which is open toward one side. The guide bar 5 by way of the nut 17 is held so as to be clamped between the clamping element 16 and a contact surface 39. The contact surface 39 is configured on the collar 38 of the stud bolt 19. The nut 17 is screwed onto the stud bolt 19 and presses the clamping element 16 against the guide bar 5 which in turn bears on the contact surface 39 of the stud bolt 19. In an alternative embodiment of the work apparatus 1 it can be expedient for the contact surface 39 not to be provided on the collar 38 of the stud bolt 19 but directly on the housing 2 of the work apparatus 1.

As is shown in FIGS. 6 and 7, the clamping element 16 includes a support ring 27, a contact ring 25, and a spring unit 18 disposed between the support ring 27 and the contact ring 25. The spring unit 18 in the embodiment is formed from a plurality of disk springs which are disposed in one row. The clamping element 16 by way of the support ring 27 bears on the end face of the nut 17, wherein the spring unit 18 presses the contact ring 25, having the clamping surface 26, against the guide bar. As a result, the clamping surface 26 of the clamping element 16 is pre-tensioned in relation to the guide bar 5. The clamping element 16 causes a clamping force by way of which the guide bar 5 is held on the housing 2, in particular between the contact surface 39 of the stud bolt 19 and the clamping surface 26 of the clamping element 16.

Figure 12:
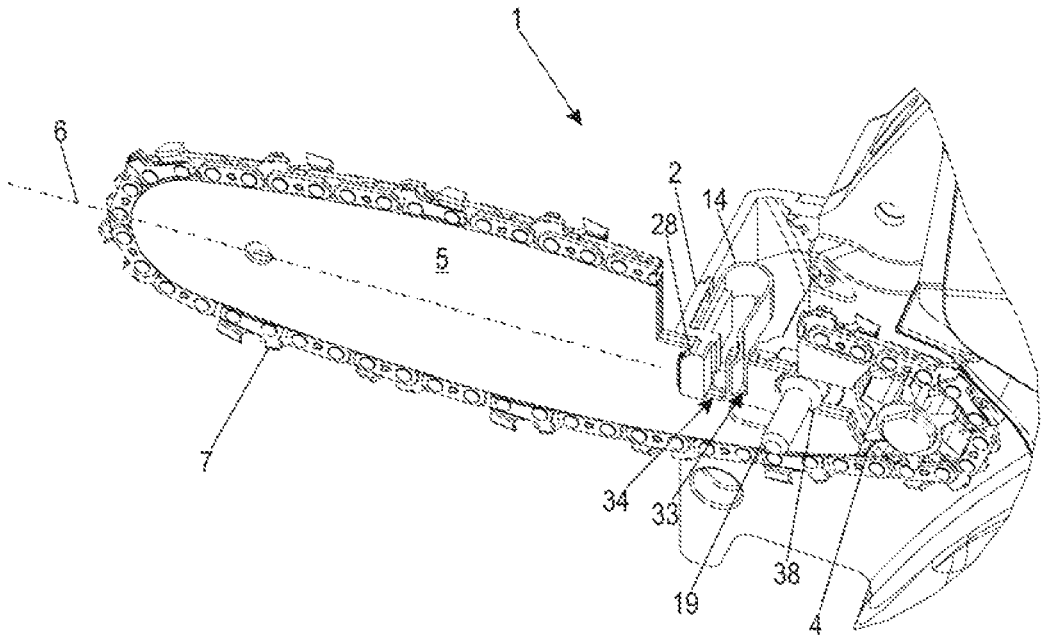

As is shown in FIG. 2, a tensioning device 10 for pre-tensioning the saw chain 7 is provided. The guide bar 5 via the tensioning device 10 is displaced toward the front, in the direction of the longitudinal axis 6 of the guide bar 5 away from the chain drive sprocket 4. The tensioning device 10 includes a spring element 14 which by way of a spring force in the direction of the longitudinal axis 6 away from the chain drive sprocket 4 acts on the guide bar 5. As is shown in FIG. 12, the spring element 14 on one end thereof is supported on the housing 2. By way of the other end, the spring element 14 engages on a spring opening 33 which is provided in the guide bar 5. The spring element 14 in the embodiment is configured as a leaf spring. In an alternative configuration, the tensioning device 10 can also be configured by way of another spring system. The tensioning device 10 acts in such a manner that the guide bar 5, when the fastening arrangement 8 is released, by way of the spring element 14 is tensioned by the spring force in the direction of the longitudinal axis 6 away from the chain drive sprocket 4. As a result, the saw chain 7 is pre-tensioned by a tensioning force. The tensioning force in this instance corresponds to the spring force of the spring element 14. The tensioning device 10 thus enables targeted, reproducible pre-tensioning of the saw chain 7 without any direct intervention by the operator.

As is shown in FIG. 2, a cutout 34 is provided on the guide bar 5, a projection 28 of the housing 2 protruding into the cutout 34. The cutout 34 of the guide bar 5 is configured as an opening. The projection 28 of the housing 2 in the direction of the longitudinal axis 6 forms a detent of the guide bar 5. At the same time, the guide bar 5 by way of the projection 28 on the cutout 34 is also guided so as to be parallel to the longitudinal axis 6 of the guide bar 5.

As is shown in FIG. 2 as well as FIGS. 8 to 11, the chain saw 1 includes a chain lifting device 11. The chain lifting device 11 includes a deflection element 12 which in the embodiment is configured as a saddle. In an alternative embodiment, the deflection element 12 can also be a magnet, in particular an electromagnet. The deflection element 12 in the embodiment is configured so as to be integral to the guide bar 5. The deflection element 12 is configured on the guide bar 5 in such a manner that the deflection element 12 as a spring element in the relaxed state protrudes into the guide groove 21 of the guide bar 5. As is shown in FIGS. 6 and 7 as well as FIGS. 8 to 11, the guide bar 5 is formed from a first side element 42 (FIG. 8), a second side element 48 (FIG. 9) and a middle element 43 (FIG. 10) disposed between the first side element 42 and the second side element 48. The deflection element 12 is configured on the middle element 43, in particular so as to be integral. The deflection element 12 is formed by a partial cutout on the middle element 43, wherein the cut-out part of the deflection element 12 is connected to the middle element by way of a web 44. The deflection element 12 is configured so as to be resilient. As a result, the deflection element 12 is displaceable, in particular pivotable, transversely to a longitudinal plane 29 defined by the guide bar 5. As is shown in FIG. 6, the deflection element 12 in the embodiment is configured in such a manner that the deflection element 12 on the bottom side 45 of the guide bar 5 engages in a guide groove 21 of the guide bar 5. The guide bar 5 includes the bottom side 45 and a top side 46. The saw chain 7 on the top side 46 of the guide bar 5 runs away from the chain drive sprocket 4, and the saw chain 7 on the bottom side 45 of the guide bar 5 runs in the direction toward the chain drive sprocket 4. Sagging of the saw chain 7 on the bottom side 45 is formed by virtue of gravity. As a result, it can be ensured that, when the chain saw 1 is held in a customary working position, the deflection element 12 when transitioning to the deflected position 40 engages between the saw chain 7 and the groove base 22. The deflection element 12 would otherwise pivot laterally toward the saw chain, as a result of which a deflection of the saw chain 7 away from the groove base 22, according to the embodiment, would no longer be possible.

As is shown in FIGS. 6 and 7, the chain saw 1 includes a positioning element 13. The positioning element 13 as a function of the position of the fastening arrangement 8 is operatively connected, preferably directly, to the deflection element 12. When the fastening arrangement 8 is in the fastened position 30 the deflection element 12 is pushed out of the guide groove 21 of the guide bar 5 by the positioning element 13. When the fastening arrangement 8 is in the released or partially released position 31, 32, there is no operative connection between the positioning element 13 and the deflection element 12. The deflection element 12 in this instance lies in the guide groove 21 of the guide bar 5. In the embodiment the positioning element 13 is disposed on the chain wheel cover 15, preferably configured so as to be integral to the chain wheel cover 15. The positioning element 13 is configured as a pin. By activating the fastening arrangement 8 the positioning element 13 is moved normally in relation to the longitudinal plane 29 of the guide bar 5. When the guide bar 5 is fixed via the fastening arrangement 8, the chain wheel cover 15, conjointly with the positioning element 13, by way of the nut 17 is displaced in the direction toward the housing 2. The positioning element 13 here presses the deflection element 12 out of the guide groove 21 of the guide bar 5. When the fastening arrangement 8 is released again, the positioning element 13 returns as a result of which the deflection element 12 pivots back into the guide groove 21 of the guide bar 5.

Figure 3:
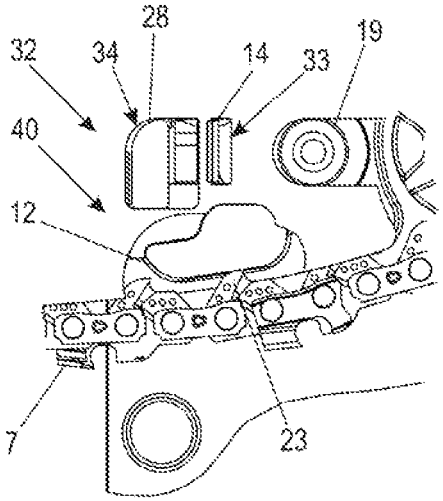
FIG. 3, in a fragmented lateral illustration, shows the chain lifting device in the deflected position with a saw chain tensioned to the maximum.
Figure 5:
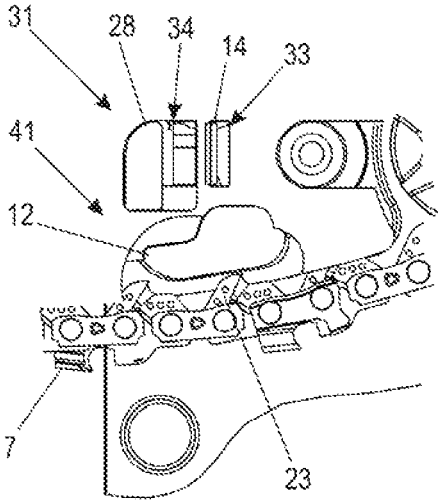
FIG. 5, in a fragmented lateral illustration, shows the chain lifting device in the deflected position with the non-tensioned saw chain.

The tensioning procedure of the saw chain 7 and the interaction between the individual functional groups of the chain saw 1 are described hereunder:

In order for the tension of the saw chain 7 to be readjusted, the nut 17 has to be released from the chain wheel cover 15. The fastening arrangement 8 here transitions from a fastened position 30 (FIG. 7) to a partially released position 31 (FIGS. 5 and 6). The chain wheel cover 15 here, conjointly with the positioning element 13, moves away from the housing 2 such that the positioning element 13 no longer acts on the deflection element 12. The deflection element 12 of the chain lifting device 11 pivots into the guide groove 21 of the guide bar 5 (FIG. 5). As is shown in FIGS. 3, 5 and 6, the chain lifting device is situated in the deflected position 40. Accordingly, the deflection element 12 is situated between drive links 23 of the saw chain 7 and the groove base 22 of the guide bar 5. The deflection element 12 by way of the contact surface thereof for the saw chain 7 lies between the groove base 22 and the guide path 20 of the guide bar 5. Accordingly, the deflection element 12 protrudes above the groove base 22 and lies below the guide path 20 of the guide bar 5.

In the partially released position 31 of the fastening arrangement 8 the guide bar 5 is still held so as to be clamped between the clamping element 16 and the housing 2. The pre-tension of the clamping element 16 that is generated by the spring unit 18 of the clamping element 16 is conceived in such a manner that the clamping force between the clamping element 16 and the guide bar 5 is sufficiently high in order for the guide bar 5 to be fixed. Accordingly, the clamping force in the partially released as well as in the fastened position 31, 30 of the fastening arrangement 8 is greater than the tensioning force of the spring element 14 of the tensioning device 10.

In a further step, the fastening arrangement 8 is further released until the latter is situated in the released position 32 (FIG. 3). The pre-tension of the clamping element 16 decreases in such a manner that the tensioning force of the tensioning device 10 is greater than the clamping force of the clamping element 16. As a result, the guide bar 5 by the tensioning device 10, in particular by the spring element 14, in the direction of the longitudinal axis 6 is pushed forward, away from the chain drive sprocket 4. The saw chain 7 is tensioned. The saw chain 7 comes to bear on the deflection element 12. As a result, the saw chain 7 in the deflected position 40 of the chain lifting device 11 and in the released position 32 of the fastening arrangement 8 remains at a predefined spacing from the guide path 20 of the guide bar 5. The saw chain 7 in this state by way of the drive links 23 thereof bears on the deflection element 12. The saw chain 7 by the deflection element 12 is lifted from the guide path 20 of the guide bar 5 toward the outside, in the direction away from the groove base 22 of the guide bar 5. At this point in time, at which the saw chain 7 is deflected by the deflection element 12 and accordingly requires a greater length of saw chain 7 in order to tightly enclose the guide bar 5, the saw chain 7 by the tensioning force of the tensioning device 10 is brought to a maximum chain tension.

Figure 4:
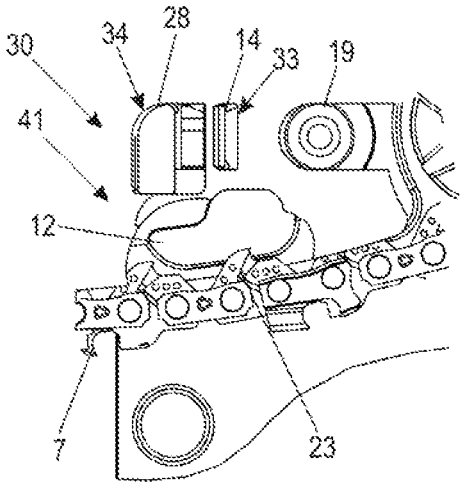
FIG. 4, in a fragmented lateral illustration, shows the chain lifting device in the operating position with the saw chain tensioned in a predefined manner.

In a further step, the fastening arrangement 8 by way of the nut 17 is again to be screwed into the partially released position 31. This has the effect that the pre-tension of the clamping element 16 is increased and the clamping force between the clamping element 16 and the guide bar 5 is greater than the tensioning force of the tensioning device 10. The guide bar 5 is fixed. By way of a further rotation of the nut 17, the chain wheel cover 15, conjointly with the positioning element 13, is subsequently displaced so far in the direction toward the housing 2 that the positioning element 13 acts on the chain lifting device 11 and pushes the deflection element 12 out of the guide groove 21 (FIG. 4). Moreover, the clamping force of the clamping element 16 is further increased until a final clamping force in the fastened position 30 of the fastening arrangement 8 is reached.

In the fastened position 30 of the fastening arrangement 8 the chain lifting device 11 is in the operating position 41. The saw chain 7 is no longer lifted by the deflection element 12, as a result of which a predetermined spacing from the guide path 20, or a predetermined play in the chain of the saw chain 7, respectively, is achieved. As a result of the deflection element 12 no longer deflecting the saw chain 7, a shorter length of saw chain 7 is required for tightly enclosing the guide bar 5, as a result of which a defined length of saw chain 7 becomes available, and the chain tension as a result being reduced in comparison to the maximum chain tension. A defined play in the chain is established as a result of the defined length differential. The fastening arrangement 8 and the chain lifting device 11 here are mutually adapted in such a manner that the obtained play in the chain of the saw chain is sufficiently minor in order to avoid that the saw chain jumps from the guide bar 5. Furthermore, the play in the chain is sufficiently large so as to preclude any jamming of the saw chain 7 on the guide bar 5.

When tensioning the saw chain 7 it is essential that the deflection element 12 contacts the saw chain 7 on the internal side of the latter that faces the guide bar 5 in order to be able to deflect the saw chain 7 away from the groove base 22 of the guide bar 5. Therefore, a chain saw 1 according to the disclosure provides a dual-stage tensioning process of the saw chain 7. While the saw chain 7 is still non-tensioned, the deflection element 12 engages in the guide groove 21. It can be ensured as a result thereof that the deflection element 12 contacts the saw chain 7 on the internal side of the latter. The saw chain 7 is only subsequently tensioned.

It is understood that the foregoing description is that of the preferred embodiments of the invention and that various changes and modifications may be made thereto without departing from the spirit and scope of the invention as defined in the appended claims.

What is claimed is:

1. A chain saw comprising:

a housing;

a saw chain;

a chain drive sprocket;

a guide bar defining a guide groove and a longitudinal axis;

said saw chain being configured to be guided in said guide groove;

a drive motor configured to drive said saw chain in a revolving manner via said chain drive sprocket;

said guide bar having a longitudinal plane defined by said guide groove;

a tensioning device;

a releasable fastening arrangement configured to hold said guide bar on said housing;

said guide bar being displaceable via said tensioning device in relation to said housing in a direction of the longitudinal axis of said guide bar when said releasable fastening arrangement is released;

a chain lifting device configured separately from said tensioning device;

said chain lifting device, when in a deflected position, being configured to deflect said saw chain when said tensioning device tensions said saw chain;

said chain lifting device, when in an operating position, being configured to relax said saw chain when said guide bar is fixed; and said chain lifting device including a deflection element configured to act on said saw chain.

2. The chain saw of claim 1, wherein said guide bar defines a guide path for said saw chain; said deflection element, in said deflected position of said chain lifting device, is configured to lift said saw chain a predetermined spacing from said guide path.

3. The chain saw of claim 1, wherein said saw chain, in said deflected position, bears on said deflection element of said chain lifting device.

4. The chain saw of claim 1, wherein said deflection element of said chain lifting device is moveable laterally to said longitudinal plane.

5. The chain saw of claim 1, wherein said deflection element of said chain lifting device is mounted so as to be pivotable in relation to said guide groove.

6. The chain saw of claim 1, wherein said guide groove has a groove base; and, said deflection element, when in said deflected position, protrudes into said guide groove of said guide bar and lifts drive links of said saw chain away from said groove base of said guide bar.

7. The chain saw of claim 1, wherein said deflection element is disposed on a bottom side of said guide bar, said saw chain on said bottom side of said guide bar running in a direction toward said chain drive sprocket.

8. The chain saw of claim 1 further comprising a positioning element configured to move said deflection element.

9. The chain saw of claim 8, wherein said positioning element acts on said deflection element when said chain lifting device is in said operating position.

10. The chain saw of claim 1, wherein said deflection element is integral with said guide bar.

11. The chain saw of claim 1, wherein said fastening arrangement is configured to act on said chain lifting device such that said chain lifting device is situated in said operating position when said fastening arrangement is in a fastened position.

12. The chain saw of claim 1, wherein said fastening arrangement and said chain lifting device are mutually configured such that said guide bar, when said fastening arrangement is released, is tensioned by said tensioning device and said chain lifting device is situated in said deflected position.

13. The chain saw of claim 1, wherein said tensioning device includes a spring element configured to pre-tension said guide bar away from said housing in a direction of said longitudinal axis of said guide bar.

14. The chain saw of claim 1, wherein said fastening arrangement and said chain lifting device are mutually configured in such a manner that said fastening arrangement in a partially released position holds said guide bar and said chain lifting device is situated in said deflected position.

15. The chain saw of claim 1, wherein said fastening arrangement includes a chain wheel cover and a clamping element disposed on said chain wheel cover; and, said guide bar via said clamping element is pressed against said housing.

16. The chain saw of claim 15, wherein said fastening arrangement includes a spring unit; and, said clamping element, via said spring unit, is mounted on said chain wheel cover transversely to the longitudinal plane of said guide bar.

17. A chain saw comprising:

a housing;

a saw chain;

a chain drive sprocket;

a guide bar defining a guide groove and a longitudinal axis;

said saw chain being configured to be guided in said guide groove;

a drive motor configured to drive said saw chain in a revolving manner via said chain drive sprocket;

said guide bar having a longitudinal plane defined by said guide groove;

a tensioning device;

a releasable fastening arrangement configured to hold said guide bar on said housing;

said guide bar being displaceable via said tensioning device in relation to said housing in a direction of the longitudinal axis of said guide bar when said releasable fastening arrangement is released;

a chain lifting device configured separately from said tensioning device;

said chain lifting device, when in a deflected position, being configured to deflect said saw chain when said tensioning device tensions said saw chain;

said chain lifting device, when in an operating position, being configured to relax said saw chain when said guide bar is fixed;

said fastening arrangement including a chain wheel cover and a clamping element disposed on said chain wheel cover;

said guide bar via said clamping element being pressed against said housing; and, wherein a clamping force acting from said clamping element on said guide bar in a fastened position and in a partially released position of said fastening arrangement is greater than a tensioning force acting from said tensioning device on said guide bar.

18. A method for tensioning a saw chain of a chain saw, the chain saw including a housing and a drive motor; the drive motor being configured to, via a chain drive sprocket, drive a saw chain guided on a guide bar in a revolving manner; the guide bar being held on the housing via a releasable fastening arrangement; and, the guide bar, when the fastening arrangement is released, being displaceable in relation to the housing in the direction of a longitudinal axis of said guide bar via a tensioning device; the method comprising:

deflecting the saw chain via a chain lifting device when the tensioning device tensions the saw chain and the chain lifting device is in a deflected position; and, relaxing the saw chain via the chain lifting device when the guide bar is fixed and the chain lifting device is in an operating position, wherein said chain lifting device includes a deflection element configured to act on the saw chain.

* * * * *